US009217245B2

(12) United States Patent
Yu

(10) Patent No.: US 9,217,245 B2
(45) Date of Patent: Dec. 22, 2015

(54) MOTORIZED DRAIN SNAKE

(71) Applicant: Mu-Tsun Yu, Taichung (TW)

(72) Inventor: Mu-Tsun Yu, Taichung (TW)

( * ) Notice: Subject to any disclaimer, the term of this patent is extended or adjusted under 35 U.S.C. 154(b) by 103 days.

(21) Appl. No.: 14/249,401

(22) Filed: Apr. 10, 2014

(65) Prior Publication Data

US 2014/0215737 A1 Aug. 7, 2014

Related U.S. Application Data

(63) Continuation-in-part of application No. 13/664,496, filed on Oct. 31, 2012, now abandoned.

(51) Int. Cl.
*B08B 9/045* (2006.01)
*E03F 9/00* (2006.01)

(52) U.S. Cl.
CPC ..... *E03F 9/005* (2013.01); *B08B 9/045* (2013.01)

(58) Field of Classification Search
CPC ..... B08B 9/045; B08B 9/043; B08B 9/04; B08B 9/027; E03F 9/005
USPC ..... 15/104.33
See application file for complete search history.

(56) References Cited

U.S. PATENT DOCUMENTS

| | | | | |
|---|---|---|---|---|
| 3,574,878 | A | 4/1971 | Shames et al. | 15/104.33 |
| 3,694,011 | A | 9/1972 | Silverman | 403/316 |
| 4,232,419 | A | 11/1980 | Sanger | 15/104.33 |
| 4,257,139 | A | 3/1981 | Yeo | 15/104.33 |
| 4,644,603 | A * | 2/1987 | Meyer | E03F 9/005 15/104.33 |
| 4,837,887 | A | 6/1989 | McLaughlin | 15/104.33 |
| 7,765,626 | B2 | 8/2010 | Sapia | 4/255.11 |
| 2007/0089254 | A1 | 4/2007 | Alaine | 15/104.33 |
| 2009/0300863 | A1 | 12/2009 | Bartucciotto | 15/104.33 |

* cited by examiner

*Primary Examiner* — Laura C Guidotti
(74) *Attorney, Agent, or Firm* — Alan D. Kamrath; Kamrath IP Lawfirm, P.A.

(57) ABSTRACT

A motorized drain snake includes a shank and a coiled member connected with the shank. The shank has a first end provided with a bushing which has an interior provided with a shaft hole for mounting the coiled member. The bushing of the shank is made of soft iron material. The bushing of the shank has an end face provided with a plurality of ramps. The coiled member is hollow, bendable and flexible. The coiled member is made of a metallic wire that is wound successively. The coiled member has a first end securely mounted in the shaft hole of the bushing of the shank and a second end provided with a drilling portion.

4 Claims, 4 Drawing Sheets

MOTORIZED DRAIN SNAKE

CROSS-REFERENCES TO RELATED APPLICATIONS

The present invention is a continuation-in-part application of the co-pending U.S. Ser. No. 13/664,496, filed on Oct. 31, 2012.

BACKGROUND OF THE INVENTION

1. Field of the Invention

The present invention relates to a drain snake and, more particularly, to a motorized drain snake for a toilet, sink, drain, waste pipe and the like.

2. Description of the Related Art

A conventional drain snake comprises a handle and a flexible member connected with the handle. When in use, the user can hold the handle to extend the flexible member into an object, such as a toilet, sink, drain, waste pipe and the like, so as to clear and remove a clog, blockage or stoppage (such as hairs, excrement and the like) in the object. However, the user has to operate and turn the drain snake manually, thereby causing inconvenience to the user, and thereby wasting the user's force and energy. In addition, the flexible member is connected with the handle by soldering so that the conventional drain snake is not assembled easily and quickly, thereby increasing the cost of assembly and fabrication. Further, the flexible member cannot be folded when not in use, thereby causing inconvenience in and increasing the costs of packaging, storage and carrying of the conventional drain snake.

BRIEF SUMMARY OF THE INVENTION

In accordance with the present invention, there is provided a motorized drain snake comprising a shank and a coiled member connected with the shank. The shank has a first end provided with a bushing which has an interior provided with a shaft hole for mounting the coiled member. The bushing of the shank is made of soft iron material. The bushing of the shank has an end face provided with a plurality of ramps. The coiled member is hollow, bendable and flexible. The coiled member is made of a metallic wire that is wound successively. The coiled member has a first end securely mounted in the shaft hole of the bushing of the shank and a second end provided with a drilling portion.

The shank has a periphery provided with a through hole. The motorized drain snake further comprises a connecting pin extended through and mounted in the through hole of the shank, and a hanging hook connected with the connecting pin for hooking the drilling portion of the coiled member. The shank has a second end provided with a coupling which is located opposite to the bushing. The coupling of the shank is adapted for being connected with a powered tool, so that the shank is driven and rotated by the powered tool. Preferably, the drilling portion of the coiled member has a spiral shape.

The primary objective of the present invention is to provide a motorized drain snake that is operated automatically without needing a manual work.

According to the primary advantage of the present invention, the coiled member is driven by the powered tool so that the motorized drain snake is operated automatically to clear and remove the clog, blockage or stoppage, thereby saving the user's energy and working time.

According to another advantage of the present invention, the coiled member is combined with the shank in a pressing manner so that it is unnecessary to combine the shank with the coiled member by soldering, thereby simplifying the working process, and thereby decreasing the cost of fabrication.

According to a further advantage of the present invention, the coiled member is combined with the shank closely and solidly so that the coiled member will not be loosened or detached from the shank.

According to a further advantage of the present invention, the drilling portion of the coiled member can be hooked onto the hanging hook so that the coiled member is bent and folded when not in use so as to reduce the whole volume of the motorized drain snake, thereby facilitating packaging, storage and carrying of the motorized drain snake.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
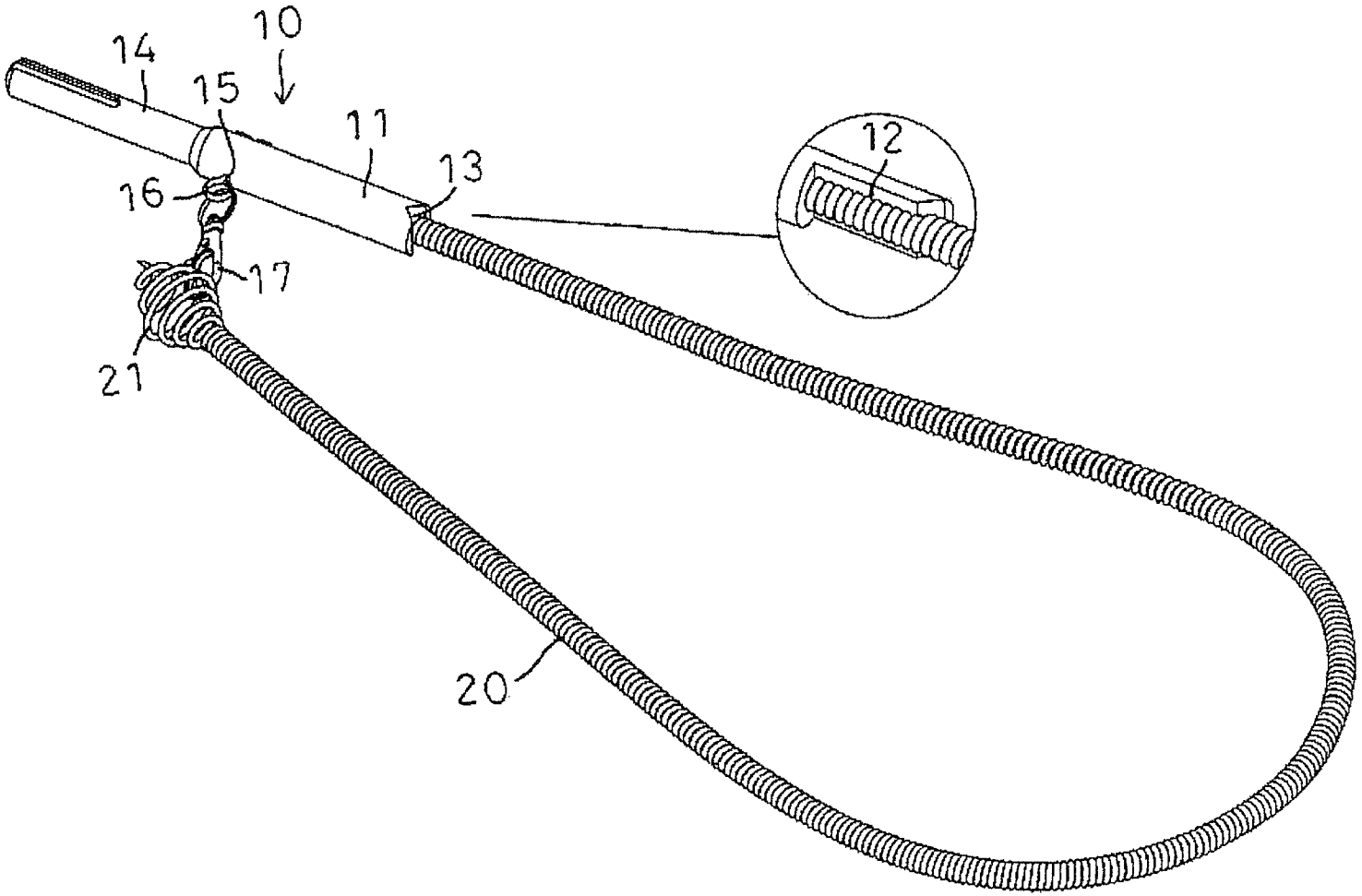
FIG. 1 is a perspective view of a motorized drain snake in accordance with the preferred embodiment of the present invention.
Figure 2:
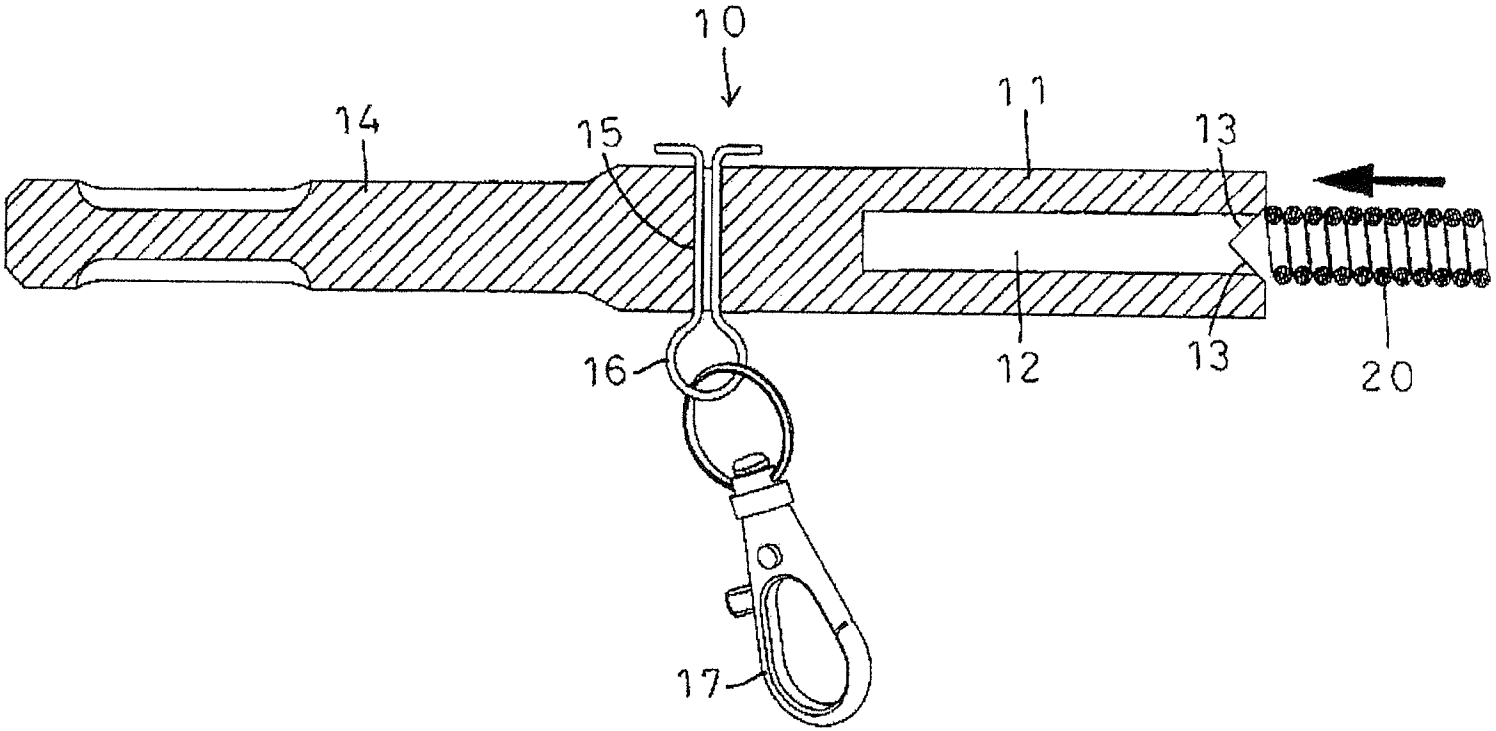
FIG. 2 is a cross-sectional view of the motorized drain snake before the coiled member is compressed.

Referring to the drawings and initially to FIGS. 1 and 2, a motorized drain snake in accordance with the preferred embodiment of the present invention comprises a shank 10 and a coiled member 20 connected with the shank 10.

The shank 10 has a first end provided with a bushing 11 which has an interior provided with a shaft hole 12 for mounting the coiled member 20. The bushing 11 of the shank 10 is made of soft iron material. The bushing 11 of the shank 10 has an end face provided with a plurality of substantially V-shaped ramps 13. The ramps 13 of the bushing 11 of the shank 10 are equally spaced from each other and are connected to the shaft hole 12 to introduce the coiled member 20 into the shaft hole 12. The shank 10 has a second end provided with a coupling 14 which is located opposite to the bushing 11. The coupling 14 of the shank 10 is adapted for being connected with a powered tool, such as an electric drill, so that the shank 10 is driven and rotated by the powered tool. The shank 10 has a periphery provided with a through hole 15. The through hole 15 of the shank 10 is extended in a radial direction of the shank 10.

The coiled member 20 is elongated, hollow, bendable and flexible. The coiled member 20 is made of a metallic wire that is wound successively. The coiled member 20 has a first end securely mounted in the shaft hole 12 of the bushing 11 of the shank 10 and a second end provided with a drilling portion 21 which is adapted for picking and dislodging a clog, blockage or stoppage (such as hairs, excrement and the like) in an object, such as a toilet, sink, drain, waste pipe and the like. The drilling portion 21 of the coiled member 20 has a spiral shape.

The motorized drain snake further comprises a connecting pin 16 extended through and mounted in the through hole 15 of the shank 10, and a hanging hook 17 connected with the connecting pin 16 for hooking the drilling portion 21 of the coiled member 20 so as to fold and reduce the volume of the coiled member 20.

Figure 3:
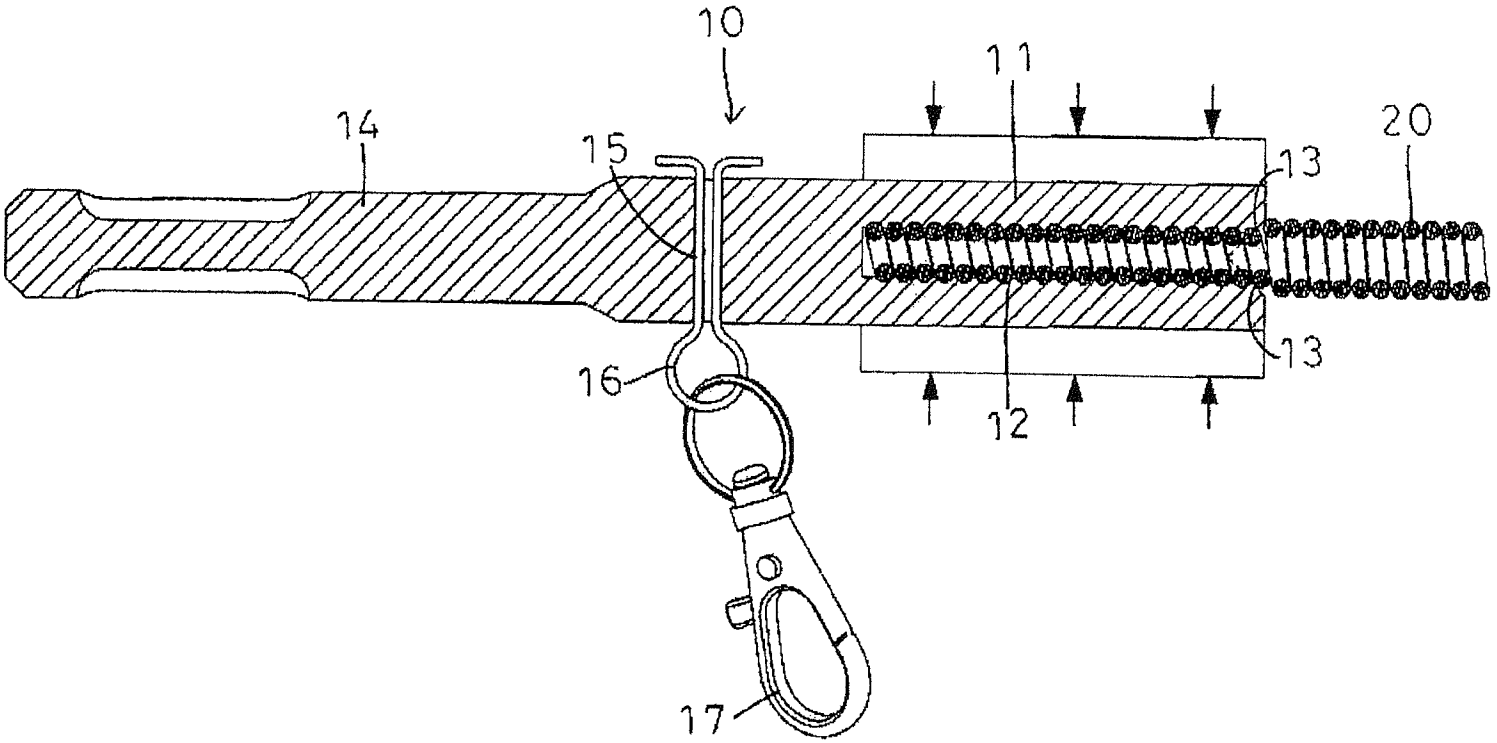
FIG. 3 is a cross-sectional view of the motorized drain snake showing the coiled member is being compressed.
Figure 4:
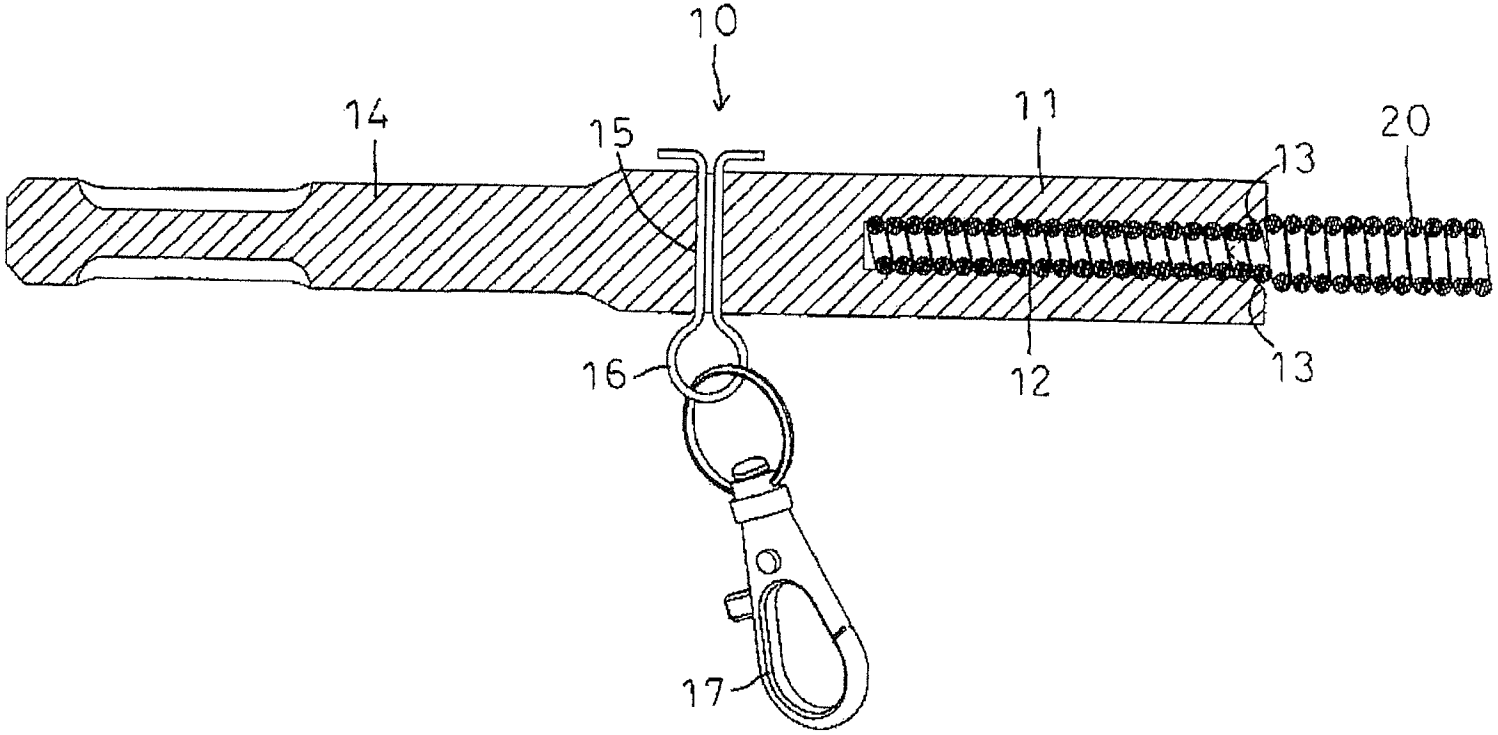
FIG. 4 is a cross-sectional view of the motorized drain snake after the coiled member is compressed.

In assembly, referring to FIGS. 2-4 with reference to FIG. 1, the first end of the coiled member 20 is initially inserted into the shaft hole 12 of the bushing 11 of the shank 10 by guidance of the ramps 13 of the bushing 11 of the shank 10 as shown in FIG. 2. Then, an external force is applied on the bushing 11 of the shank 10 to compress and deform the bushing 11 of the shank 10 so that the bushing 11 of the shank 10 is pressed toward the coiled member 20 as shown in FIG. 3. At this time, the ramps 13 of the bushing 11 of the shank 10 prevent the coiled member 20 from being broken during the pressing process. In such a manner, the first end of the coiled member 20 is secured in the shaft hole 12 of the bushing 11 of the shank 10 as shown in FIG. 4 so that the first end of the coiled member 20 is combined integrally with the bushing 11 of the shank 10.

As shown in FIG. 1, the drilling portion 21 of the coiled member 20 is hooked onto the hanging hook 17 so that the coiled member 20 is bent and folded when not in use so as to reduce the whole volume of the motorized drain snake.

In operation, the coupling 14 of the shank 10 is adapted for engaging the powered tool to connect the shank 10 with the powered tool 2, so that the shank 10 can be driven and rotated by the powered tool. Then, the drilling portion 21 of the coiled member 20 is inserted into a substantially U-shaped channel of a toilet. Then, the powered tool is started to rotate the coiled member 20 so that the drilling portion 21 of the coiled member 20 is turned and extended deeply into the U-shaped channel of the toilet so as to pick and clear the clog, blockage or stoppage in the U-shaped channel of the toilet. Then, the coiled member 20 is pulled outward to detach the drilling portion 21 of the coiled member 20 from the U-shaped channel of the toilet so as to dislodge and remove the clog, blockage or stoppage from the U-shaped channel of the toilet.

Accordingly, the coiled member 20 is driven by the powered tool so that the motorized drain snake is operated automatically to clear and remove the clog, blockage or stoppage, thereby saving the user's energy and working time. In addition, the coiled member 20 is combined with the shank 10 in a pressing manner so that it is unnecessary to combine the shank 10 with the coiled member 20 by soldering, thereby simplifying the working process, and thereby decreasing the cost of fabrication. Further, the coiled member 20 is combined with the shank 10 closely and solidly so that the coiled member 20 will not be loosened or detached from the shank 10. Further, the drilling portion 21 of the coiled member 20 can be hooked onto the hanging hook 17 so that the coiled member 20 is bent and folded when not in use so as to reduce the whole volume of the motorized drain snake, thereby facilitating packaging, storage and carrying of the motorized drain snake.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A motorized drain snake comprising:

a shank; and a coiled member connected with the shank; wherein:

the shank has a first end provided with a bushing which has an interior provided with a shaft hole for mounting the coiled member;

the bushing of the shank is made of soft iron material;

the bushing of the shank has an end face provided with a plurality of ramps;

the coiled member is hollow, bendable and flexible;

the coiled member is made of a metallic wire that is wound successively; and the coiled member has a first end securely mounted in the shaft hole of the bushing of the shank and a second end provided with a drilling portion.

2. The motorized drain snake of claim 1, wherein:

the shank has a periphery provided with a through hole; and the motorized drain snake further comprises:

a connecting pin extended through and mounted in the through hole of the shank; and a hanging hook connected with the connecting pin for hooking the drilling portion of the coiled member.

3. The motorized drain snake of claim 1, wherein:

the shank has a second end provided with a coupling which is located opposite to the bushing; and the coupling of the shank is adapted for being connected with a powered tool, so that the shank is driven and rotated by the powered tool.

4. The motorized drain snake of claim 1, wherein the drilling portion of the coiled member has a spiral shape.

* * * * *